US012220024B2

(12) United States Patent
Millward

(10) Patent No.: US 12,220,024 B2
(45) Date of Patent: Feb. 11, 2025

(54) BUCKLE

(71) Applicant: Illinois Tool Works Inc., Glenview, IL (US)

(72) Inventor: Eric W. Millward, Des Plaines, IL (US)

(73) Assignee: Illinois Tool Works Inc., Glenview, IL (US)

( * ) Notice: Subject to any disclaimer, the term of this patent is extended or adjusted under 35 U.S.C. 154(b) by 19 days.

(21) Appl. No.: 18/142,849

(22) Filed: May 3, 2023

(65) Prior Publication Data

US 2023/0404219 A1 Dec. 21, 2023

Related U.S. Application Data

(63) Continuation-in-part of application No. 29/858,329, filed on Oct. 31, 2022.

(60) Provisional application No. 63/345,972, filed on May 26, 2022.

(51) Int. Cl.
*A44B 11/26* (2006.01)
*A44B 11/25* (2006.01)

(52) U.S. Cl.
CPC ..... *A44B 11/263* (2013.01); *A44B 11/2546* (2013.01)

(58) Field of Classification Search
CPC . A44B 11/266; A44B 11/263; A44B 11/2546; A44B 11/2519; A44B 11/2523; A44B 11/2515; A44B 11/2511
USPC ..... 24/633–642
See application file for complete search history.

(56) References Cited

U.S. PATENT DOCUMENTS 3,996,648 A * 12/1976 Romanzi, Jr. ..... A44B 11/2511 24/650
4,408,373 A * 10/1983 Miskowicz ..... A44B 11/2511 24/664
4,631,787 A 12/1986 Kasai
4,639,982 A 2/1987 Kasai
4,677,716 A * 7/1987 Monsigny ..... A44B 11/2523 24/639
4,703,542 A * 11/1987 Hirata ..... A44B 11/2523 24/641

(Continued)

FOREIGN PATENT DOCUMENTS

EP 1400183 3/2004

OTHER PUBLICATIONS

The extended European search report for Application No. 21179512.5 dated Nov. 4, 2021, European Patent Office, Germany (9 pages).

(Continued)

*Primary Examiner* — Robert Sandy
(74) *Attorney, Agent, or Firm* — McAndrews, Held & Malloy, Ltd.

(57) ABSTRACT

Disclosed is a buckle assembly having a female buckle component and a male buckle component. The female buckle component configured to mate with a male buckle component and including a housing, a button aperture, and a pocket. The pocket includes an alignment edge at an opening of the pocket. The male buckle component includes a main body, guide bars, and lateral arms. Each lateral arm is coupled to the main body and configured to deflect about a pivot point. Each lateral arm includes a flexible lateral arm, a button, locking tips, and a guide fin.

20 Claims, 9 Drawing Sheets

(56) References Cited

U.S. PATENT DOCUMENTS

| | | | | |
|---|---|---|---|---|
| 5,027,481 | A | 7/1991 | Frano | |
| 5,203,058 | A | 4/1993 | Krauss | |
| D341,105 | S | 11/1993 | Lovato | |
| D349,262 | S | 8/1994 | Krauss | |
| D373,747 | S | 9/1996 | Anscher | |
| D405,726 | S | 2/1999 | Krauss | |
| 6,226,844 | B1 | 5/2001 | Lerra | |
| 6,615,460 | B1 | 9/2003 | Baumgarten | |
| 7,089,633 | B2 | 8/2006 | Liu | |
| 7,111,368 | B2 | 9/2006 | Matoba | |
| 7,140,082 | B2 | 11/2006 | Chen | |
| D535,912 | S | 1/2007 | Pontaoe | |
| D536,279 | S | 2/2007 | Grimm | |
| 7,174,609 | B2 * | 2/2007 | Park | A44B 11/266 24/615 |
| 7,178,208 | B2 * | 2/2007 | Bentsen | A44B 11/2503 24/631 |
| 7,302,742 | B2 | 12/2007 | Pontaoe | |
| D576,521 | S | 9/2008 | Kolasa | |
| 7,979,966 | B2 | 7/2011 | Yoshie | |
| 8,256,072 | B2 | 9/2012 | Kolasa | |
| 8,572,820 | B2 | 11/2013 | Richards | |
| 8,601,652 | B2 | 12/2013 | Uehara | |
| 9,655,412 | B2 | 5/2017 | Nanbu | |
| 9,750,310 | B2 | 9/2017 | Kolasa | |
| 10,765,176 | B2 * | 9/2020 | Castiglione | A41D 13/1161 |
| D945,313 | S | 3/2022 | Millward | |
| 11,259,604 | B2 | 3/2022 | Kolasa | |
| 2007/0017074 | A1 | 1/2007 | Pontaoe | |
| 2008/0134479 | A1 | 6/2008 | Kolasa | |
| 2011/0219590 | A1 | 9/2011 | Anscher | |
| 2013/0232743 | A1 | 9/2013 | Takazakura | |

OTHER PUBLICATIONS

X-Stealth Side-Release Buckle, No Date Available, Ortlieb, Site Visited on Feb. 17, 2023: https://www.ortlieb.com/en_us/side-release-buckle-stealth-25mm (Year: 2023).

* cited by examiner

BUCKLE

RELATED APPLICATION

The present application claims priority to U.S. Provisional Patent Application No. 63/345,972, filed May 26, 2022, and U.S. Design patent application No. 29/858,329, filed Oct. 31, 2022, each of which is entitled "Buckle" and is hereby incorporated by reference in its entirety.

FIELD

The present disclosure generally relates to two-part buckles that include a male component snapped into a female component, and more particularly to a buckle with improved alignment features.

BACKGROUND

Two-piece buckles that snap together and latch automatically upon adequately inserting a male component into a female component are known and used in a variety of applications. A piece of webbing or strap can be attached to each of the components, and one or both buckle components can be adjustably retained on the strap or webbing. It is also known to have both components in fixed locations relative to a strap or web that is sewn or otherwise fixedly secured to the buckle component. Such buckles are known and used for a variety of applications, including outdoor recreational products like backpacks, bike helmets and life vests and other equipment. Two-part buckles are used also on luggage, bags, clothing and the like.

In order to properly assemble a two-piece buckle, the male and female components need to be aligned. However, in practical use the male and female components are often not aligned properly. It would therefore be highly desirable to provide a buckle assembly with progressive alignment features.

SUMMARY

The present disclosure generally relates to two-part buckles that include a male component snapped into a female component, and more particularly to a buckle with improved alignment features, substantially as illustrated by and described in connection with at least one of the figures, as set forth more completely in the claims.

DRAWINGS

The foregoing and other objects, features, and advantages of the devices, systems, and methods described herein will be apparent from the following description of particular examples thereof, as illustrated in the accompanying figures; where like or similar reference numbers refer to like or similar structures. The figures are not necessarily to scale, emphasis instead being placed upon illustrating the principles of the devices, systems, and methods described herein.

DETAILED DESCRIPTION

Figure 1A:
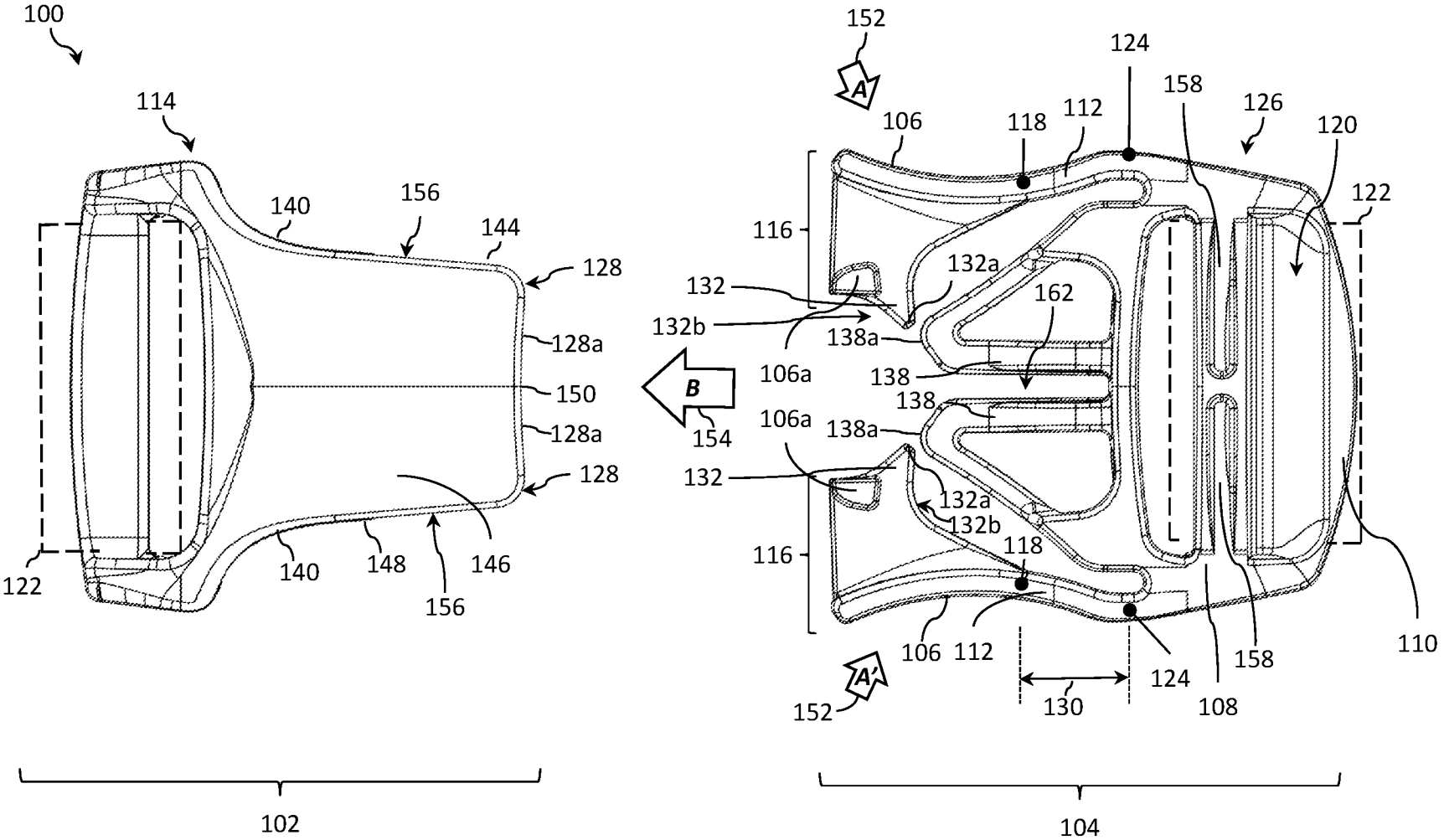
FIGS. 1A and 1B illustrate, respectively, top plan views of disconnected and connected buckle assemblies in accordance with aspects of this disclosure.

References to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Recitation of ranges of values herein are not intended to be limiting, referring instead individually to any and all values falling within and/or including the range, unless otherwise indicated herein, and each separate value within such a range is incorporated into the specification as if it were individually recited herein. In the following description, it is understood that terms such as "first," "second," "top," "bottom," "side," "front," "back," and the like are words of convenience and are not to be construed as limiting terms. For example, while in some examples a first side is located adjacent or near a second side, the terms "first side" and "second side" do not imply any specific order in which the sides are ordered.

The terms "about," "approximately," "substantially," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the disclosure. The use of any and all examples, or exemplary language ("e.g.," "such as," or the like) provided herein, is intended merely to better illuminate the disclosed examples and does not pose a limitation on the scope of the disclosure. The terms "e.g.," and "for example" set off lists of one or more non-limiting examples, instances, or illustrations. No language in the specification should be construed as indicating any unclaimed element as essential to the practice of the disclosed examples.

The term "and/or" means any one or more of the items in the list joined by "and/or." As an example, "x and/or y" means any element of the three-element set {(x), (y), (x, y)}. In other words, "x and/or y" means "one or both of x and y". As another example, "x, y, and/or z" means any element of the seven-element set {(x), (y), (z), (x, y), (x, z), (y, z), (x, y, z)}. In other words, "x, y, and/or z" means "one or more of x, y, and z."

A buckle assembly can be used to join two or more components, such as a lead (e.g., straps, ropes, strips, cordage, or another material to be fastened). Such buckles may have various uses in different applications. For example, a buckle assembly may be used on bags, safety gear (e.g., helmets), collars, or any other application that may need to be fastened.

In one example, a female buckle component is configured to mate with a male buckle component into a securely connected position, where the female buckle component comprises: a housing that comprises a first side and a second side separated by a central rib, wherein each side of the housing defines: a button aperture configured to secure the button of a male buckle component; and a pocket configured to receive the male buckle component, wherein the pocket comprises an alignment edge at an opening of the pocket.

In some examples, the alignment edge may be configured to align a male buckle component to be parallel with the female buckle component. The alignment edge may define a chamfered edge. The chamfered edge may be configured to extend away from a central plane that extends perpendicular to the central rib. In some examples, the angle of the chamfered edge may be less than about 90° relative to the central plane. In other examples, the angle of the chamfered edge may be about 35° relative to the central plane.

In some examples, each side of the housing comprises one or more locking ledges configured to receive one or more locking tips of a male buckle component.

In another example, a buckle assembly comprises: a female buckle component configured to mate with a male buckle component into a securely connected position, said female buckle component comprising a housing comprising a first side and a second side separated by a central rib, wherein each side of the housing defines: a button aperture configured to secure the button of a male buckle component; a pocket; and one or more locking ledges; the male buckle component configured to mate with the female buckle component, the male buckle component comprising: a main body; a first guide bar and a second guide bar coupled to the main body; and a first lateral arm and a second lateral arm coupled to the main body and configured to deflect about a pivot point, each of the first lateral arm and the second lateral arms comprising: a flexible lateral arm; a button; one or more locking tips configured to engage the one or more locking ledges of the female buckle component; and a guide fin.

In some examples, the relative positions of the guide fins and guide bars are configured to align the male buckle component with the female buckle component. The distal end of the first guide fin and the distal tip of the first guide bar may be positioned to define a first gap and the distal tip of the second guide fin and the distal tip of the second guide bar may be positioned to define a second gap, wherein each gap is smaller than the width of the central rib of the female buckle component. The first guide bar and the second guide bar can be positioned to define a space that is configured to engage with the central rib of the female buckle component. The width of the space defined by the first guide bar and the second guide bar can be equal to or greater than the width of the central rib of the female buckle component. In some examples, the width of the space defined by the first guide bar and the second guide bar is greater than the width of the central rib of the female buckle component.

In some examples, the first and second gaps enable the progressive guidance of the central rib of the female buckle component into the space defined by the first guide bar and the second guide bar.

In some examples, each lateral arm comprises two locking tips. The distal tip of the first guide fin and the distal tip of the first guide bar can be sized and positioned to define a first clearance and the distal tip of the second guide fin and the distal tip of the second guide bar are positioned to define a second clearance. In further examples, the first and second clearance enable the one or more locking tips to disengage the one or more locking tips from the one or more locking ledges of the female buckle component.

Figure 1B:
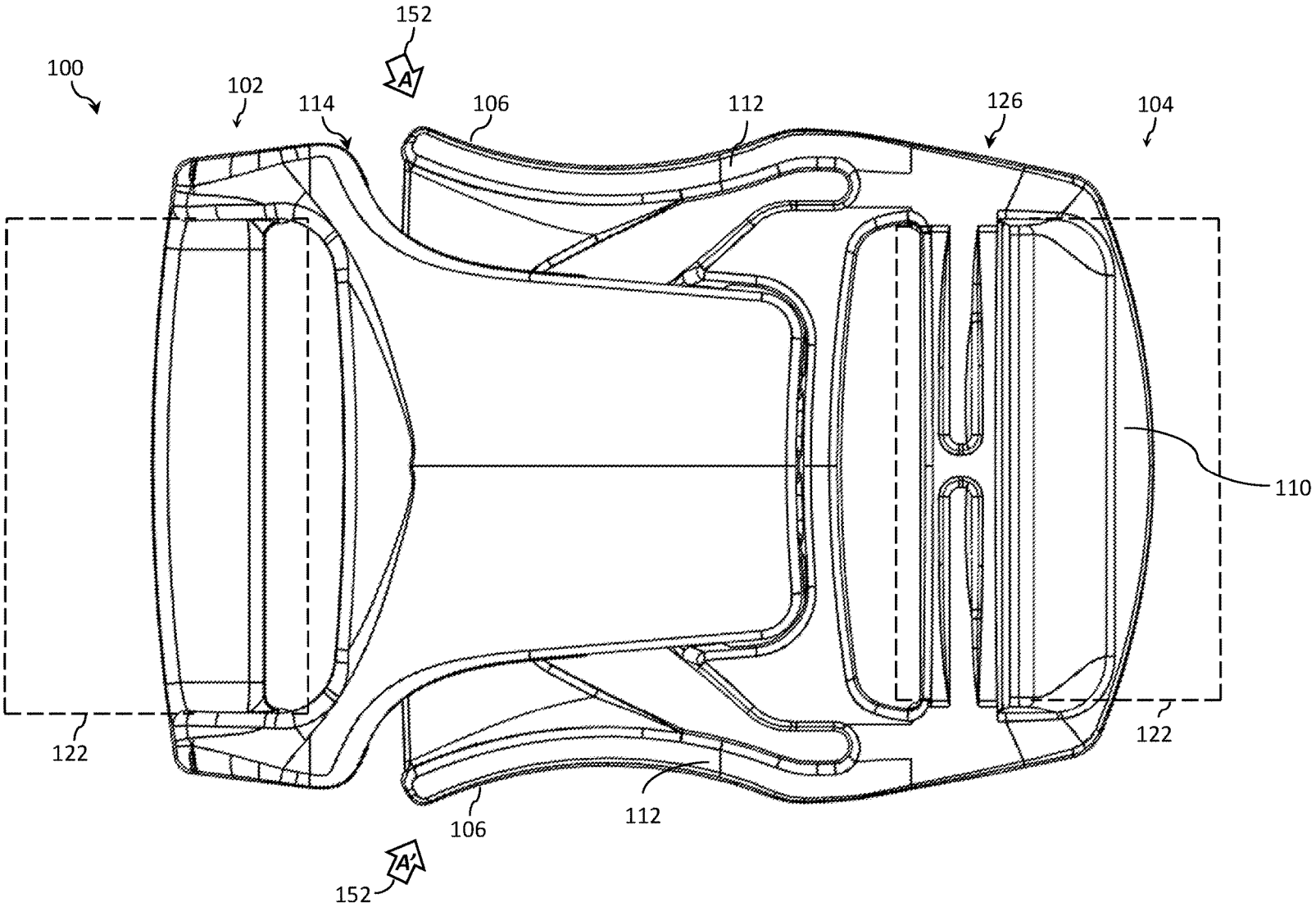

FIG. 1A illustrates a top plan view of a disconnected buckle assembly 100, while FIG. 1B illustrates a top plan view of a connected buckle assembly 100. As illustrated, the buckle assembly 100 includes a female buckle component 102 and a male buckle component 104. In operation, one or more guide bars 138 is inserted into and received by a pocket 128 of female buckle component 102 to latch the buckle assembly 100. For example, a pair of guide bars 138 may be inserted via an insertion force 154, which is indicated by Arrow B. The buckle assembly is 100 is released or disconnected by providing compression forces 152 inwardly from the side as indicated by Arrows A and A'. The male buckle component 104 and the female buckle component 102 can be made as individual monolithic structures of plastic formed by injection molding processes, engineered plastic, moldable plastic, computer numerical control (CNC) machining, or the like.

Leads 122 can be attached to each of the male buckle component 104 and the female buckle component 102 so that buckle assembly 100 can be used to secure together opposite ends of a single lead 122 or to secure ends of separate leads 122. Example leads 122 include, inter alia, straps (e.g., backpack straps, belts, etc.), ropes, strips, cordage, or another material to be fastened. The leads 122 may be fabricated from, for example, plastic, nylon, leather, fabric, etc. In some examples, each of the male buckle component 104 and the female buckle component 102 may be adjustably positioned along the length of a lead 122. Other structures, or components, however, may be used to couple to the male buckle component 104 and/or the female buckle component 102 in addition to, or in lieu of, the leads 122. For example, the male buckle component 104 and/or the female buckle component 102 may be coupled to an item (e.g., bag, belt, garment, etc.) via mechanical fasteners (e.g., snaps, rivets, carabiner clips, etc.), adhesives, etc.

In order to securely mate the male buckle component 104 into the female buckle component 102, the male buckle component 104 is urged into the female buckle component 102 via insertion force 154. The female buckle component 102 defines a receiving body or pocket 128. In some examples, the female buckle component 102 includes a housing 114 formed as a set of plates spaced apart and secured at the edges via the sides 144 to form a pocket-like structure to define the pocket 128. The sides 144 of the housing 114 are shaped to define button apertures 140 (e.g., apertures in the sides 144). The button apertures 140 are sized and positioned to receive buttons 106 when the male buckle component 104 is fully inserted into the pocket 128 of the female buckle component 102. The pocket 128 may further define one or more channels to define a guide way to direct male buckle component 104 straight into female buckle component 102 from an entrance opening 128*a* to the pocket 128. The one or more channels may be formed on, for example, the interior surface of the set of plates 146. The one or more channels may be defined by a central rib 150 that extends across the length of the female buckle component 102.

The one or more channels may be configured to guide the male buckle component 104 via one or more guide bars 138 that outwardly extend from a rigid strut member 108. To this end, a pair of guide bars may be positioned to define a space 162 that is configured to engage with the central rib 150 of the female buckle component 102. For example, using insertion force 154 as indicated by Arrow B, the guide bars 138 pass into a mating channel or sleeve formed in the female buckle component in order to assure proper mating alignment. Once the buttons 106 are snapably secured into the button apertures 140 in the female buckle component 102 (e.g., via engagement of one or more locking tips 106*a* of male buckle component 104 with one or more locking ledges 148 of female buckle component 102), the male buckle component 104 is securely retained within the female buckle component 102.

The housing 114 further includes one or more locking ledges 148 to interface with the male buckle component 104. For example, an edge of each button aperture 140 nearest the entrance opening 128*a* to the pocket 128 may define the locking ledge 148 or be provided another form of pediment. The locking ledges 148 may interface with the male buckle component 104 via engagement with locking tips 106*a* of the female buckle component 102. For example, one or more lateral arm members 116 may outwardly extend from rigid strut member 108. Each lateral arm member 116 may comprise one or more locking tips 106*a*. The locking tips 106*a* may, in some examples, form a portion of the button 106. In other examples, the locking tips 106*a* may comprise distinct components. In some examples, each lateral arm member 116 may comprise a single locking tip 106*a*. In other examples, each lateral arm member 116 may comprise two locking tips 106*a* (e.g., one locking tip 106*a* located on each face of the lateral arm member 116.) Using insertion force 154 as indicated by Arrow B, the locking tips 106*a* of the male buckle component 104 are engaged with the locking ledges 148 of female buckle component 102 to form a securely connected position.

As described above, the male buckle component 104 includes a pair of lateral arm members 116. While the pair of lateral arm members 116 are illustrated as generally parallel to one another, they may be non-parallel. Each of the lateral arm members 116 includes a flexible lateral arm 112 with a button 106 at a distal end 118 thereof. The distal end 118 of each of the lateral arm members 116 further includes a guide fin 132. As illustrated, the flexible lateral arms 112 are spaced apart and may be generally parallel to one another. In some examples, the flexible lateral arms 112, the buttons 106, and the guide fins 132 are fabricated as a unitary structure. In other examples, the flexible lateral arms 112, the buttons 106, and the guide fins 132 are distinct components. For example, the buttons 106 may be a solid rigid button coupled to an end of the flexible lateral arm 112 and the guide fins 132 may be a solid rigid guide fin coupled to an end of the button 106. In other examples, the flexible lateral arm 112 may be configured to form a non-linear portion that defines, or otherwise serves as, the button 106. For example, the flexible lateral arm 112 may shaped to define the button 106. Similarly, the flexible lateral arm 112 (or the button 106) may also be configured to form a non-linear portion that defines, or otherwise serves as, the guide fin 132. In any arrangement, the lateral arm members 116 (or buttons 106) further comprise a locking tip 106*a* to engage the female buckle component 102. For example, the locking tip 106*a* may engage a locking ledge 148 defined by the housing 114 of the female buckle component 102. In some examples, the locking tips 106*a* may be a distinct component (e.g., the locking tips 106*a* may be a rigid coupled to the end of the button 106). In other examples, the button 106 (or flexible lateral arm 112) may be configured to form a portion that defines, or otherwise serves as, the locking tips 106*a*.

In some examples, the rigid strut member 108 extends between the lateral arm members 116. The rigid strut member 108 is generally perpendicular to the lateral arm members 116. A lead-receiving channel 120 is formed through the male buckle component 104 between, for example, the rigid strut member 108 and a lead bar 110. In some examples, the rigid strut member 108 and the lead bar 110 are parallel to one another. The lead-receiving channel 120 is configured to secure the lead 122. The lateral arm members 116 are integrally connected to the main body 126 at pivot points 124 (e.g., via the rigid strut member 108). The lateral arm members 116 are configured to pivot (e.g., flex) in the direction of arcs A and A' about pivot points 124 defined by the union of the rigid strut member 108 and the lateral arm members 116. In other words, the lateral arm members 116 are rigidly coupled at pivot points 124 and configured to flex inwardly along its length (e.g., its effective length 130) in the direction of arcs A and A'.

In general, the rigid strut member 108 is disposed between the pivot points 124 and adjacent the lead-receiving channel 120. In one example, the pivot points 124 are proximate the rigid strut member 108 of the main body 126. As such the pivot points 124 are distally located from the lead bar 110 and the rigid strut member 108. As shown in FIG. 1A, the rigid strut member 108 extends between the lateral arm members 116 and is integrally connected with the lead bar 110 to form a main body 126 of the male buckle component 104. Thus, the rigid strut member 108 is inflexible. In some examples, the rigid strut member 108 may be a continuous solid component. In other examples, the rigid strut member 108 may comprise one or more openings located along the length of the rigid strut member 108 (e.g., openings 158). While the main body 126 is illustrated with a rigid strut member 108, the rigid strut member 108 may be omitted and the lateral arm members 116 can be integrally connected to the main body 126 at another location. For example, the lateral arm members 116 can be connected at the lead bar 110.

In operation, the pair of lateral arm members 116 is inserted into and received by the pocket 128 of female buckle component 102 as indicated by Arrow B to latch the buckle assembly 100. As described above, a pair of guide bars 138 may be positioned to define a space 162 that is configured to engage with the central rib 150 of the female buckle component 102. In order to secure the male buckle component 104 into the female buckle component 102, the male buckle component 104 is urged into the female buckle component 102 in the direction of Arrow B. The space 162 defined by the guide bars 138, upon insertion force 154, may move to engage with the central rib 150 to ensure proper mating alignment between the female and male buckle components 102 and 104, respectively.

As the male buckle component 104 is urged into the female buckle component 102, the lateral arm members 116 deflect outwardly (e.g., deformed or flexed) in the opposite directions of Arrows A and A' until the buttons 106 reach button apertures 140 formed by the female buckle component 102. To that end, the flexible lateral arm 112 is configured to flex along its effective length 130 between the pivot point 124 and the distal end 118 of the flexible lateral arm 112 during connecting and disconnecting of the buckle assembly 100. The effective length 130 is a function of the shape of the flexible lateral arm 112. For purposes of this disclosure, the effective length 130 refers to the length along the flexible lateral arm 112 to enable the flexible lateral arm 112 to flex between the pivot point 124 and the distal end 118 of the flexible lateral arm. In the example of FIGS. 1A and 1B, the flexible lateral arms 112 are generally curved with a rigid button 106 coupled at the distal end 118 that comprises the one or more locking tips 106*a*. When the locking tips 106*a* engage with the locking ledges 148, the male buckle component 104 is secured to the female buckle component 102.

Figure 5:
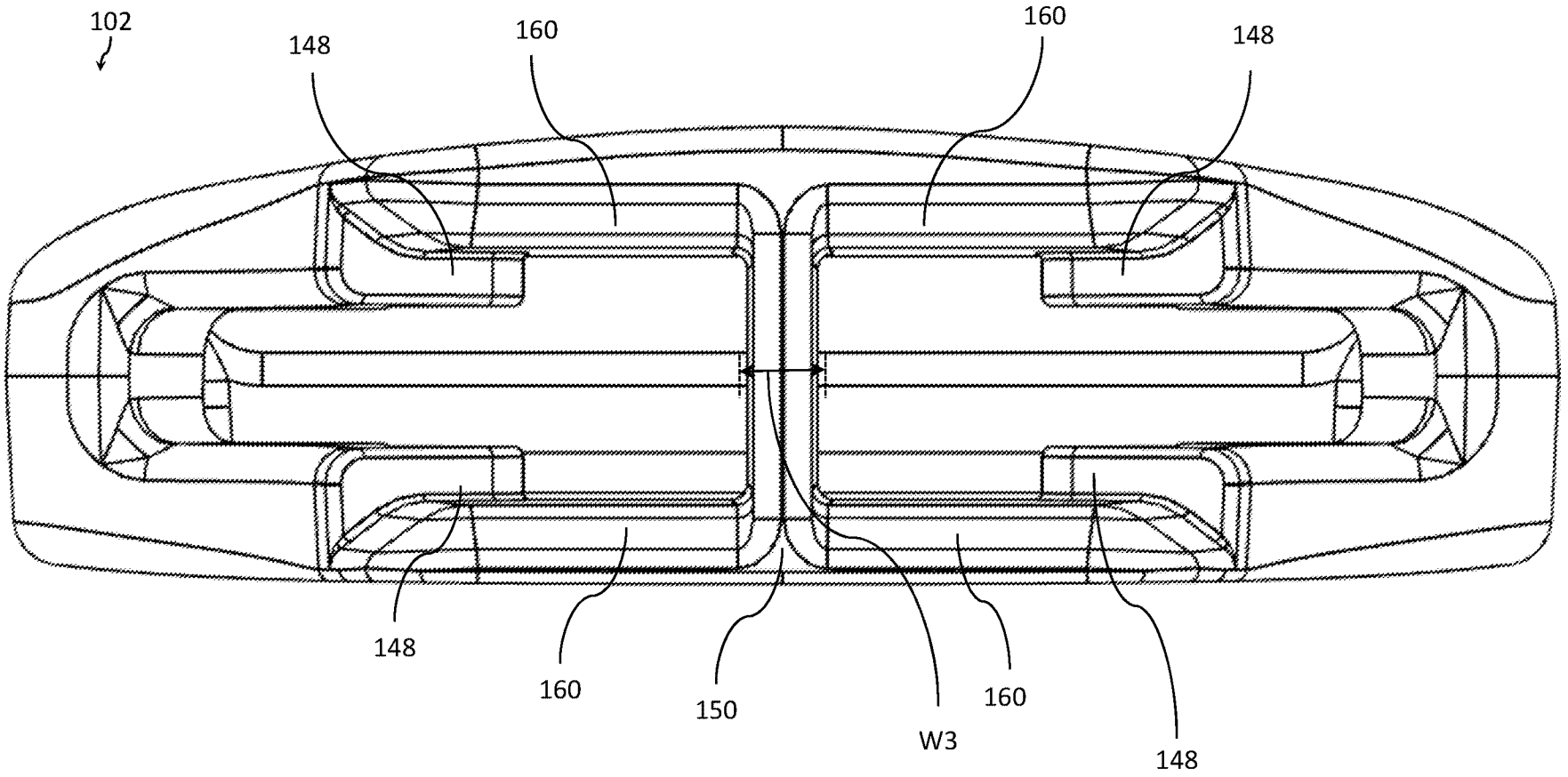
FIG. 5 illustrates another view of a disconnected buckle assembly with a female buckle component in accordance with aspects of the disclosure.

In operation, the male buckle component 104 and the female buckle component 102 need to be properly aligned from a top view in order to form a securely connected buckle assembly 100. More specifically, the central rib 150 of the female buckle component 102 needs to rest between the guide bars 138, while still allowing the flexible lateral arms 112 to flex and initiate release of the buckle assembly 100. FIG. 5 illustrates a front view of female buckle component 102. As illustrated, the space 162 defined by the guide bars 138 is equal to or greater than the width W3 of the central rib 150 of the female buckle component 102.

In order to ensure proper alignment of the male buckle component 104 and the female buckle component 102 from a top view, the guide fins 132 can be configured to progressively guide the space 162 defined by the guide bars 138 of the male buckle component 104 around the central rib 150 female buckle component 102 as the male buckle component 104 is urged into the female buckle component 102 via insertion force 154. To that end, the shape of the guide fins 132 may be configured to aid in the progressive guidance (e.g., the guide fins 132 may comprise a curved edge 132*b* that aids in progressive guidance and alignment). Further, the relative sizes and positions of the guide fins 132 and the guide bars 138 can be configured to progressively align the space 162 with the central rib 150 during assembly. For example, the guide fins 132 and guide bars 138 can be sized and positioned such that the distal tip 132*a* of a guide fin 132 and the distal tip 138*a* of a guide bar 138 define a gap 164 that has a size that is less than the width W3 of the central rib 150.

Figure 4:
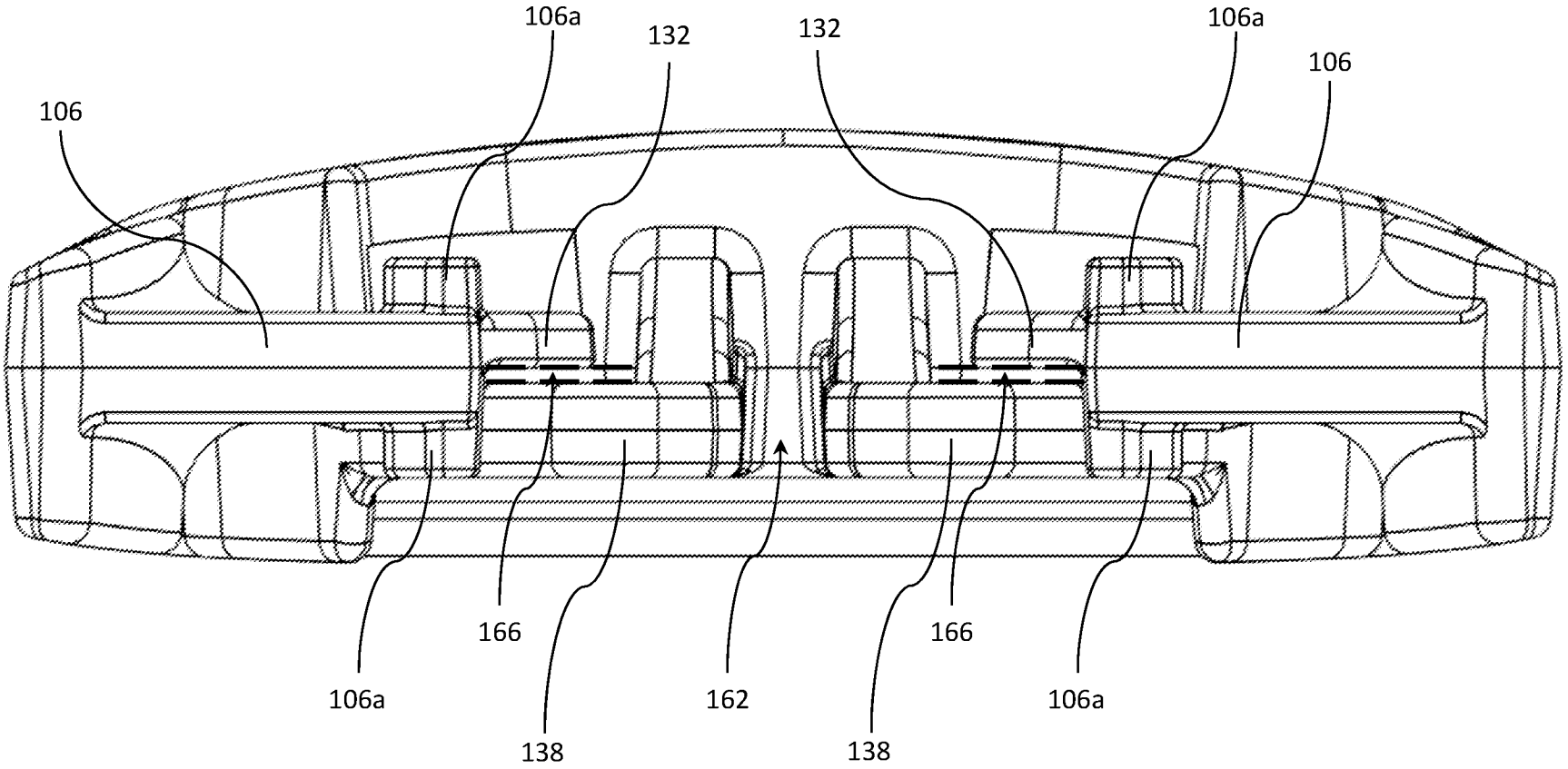
FIG. 4 illustrates another view of a disconnected buckle assembly with a male buckle component in accordance with aspects of this disclosure.

As described above, the buckle assembly is 100 is released or disconnected by providing compression forces 152 inwardly from the side as indicated by Arrows A and A'. FIG. 1B illustrates a top plan view of the buckle assembly 100 in which the male buckle component 104 is securely mated into the female buckle component 102. In order to disconnect the male buckle component 104 from the female buckle component 102, the buttons 106 are squeezed inwardly (e.g., from the sides) towards one another in the direction of Arrows A and A'. As compression forces 152 are applied, the flexible lateral arm 112 can flex inwardly (i.e., toward guide bars 138) such that each guide fin 132 will partially of fully overlap with the distal tip 138*a* of a guide bar 138. As such, the relative sizes and positions of the guide fins 132 and guide bars 138 are configured to facilitate such alignment during the release or disconnection of buckle assembly 100. FIG. 4 illustrates a front view of a male buckle component 104. As illustrated, the guide fins 132 and guide bars 138 are sized and positioned to define a clearance 166 that enables overlap of the guide fins 132 and guide bars 138 upon application of compression forces 152.

Figure 2A:
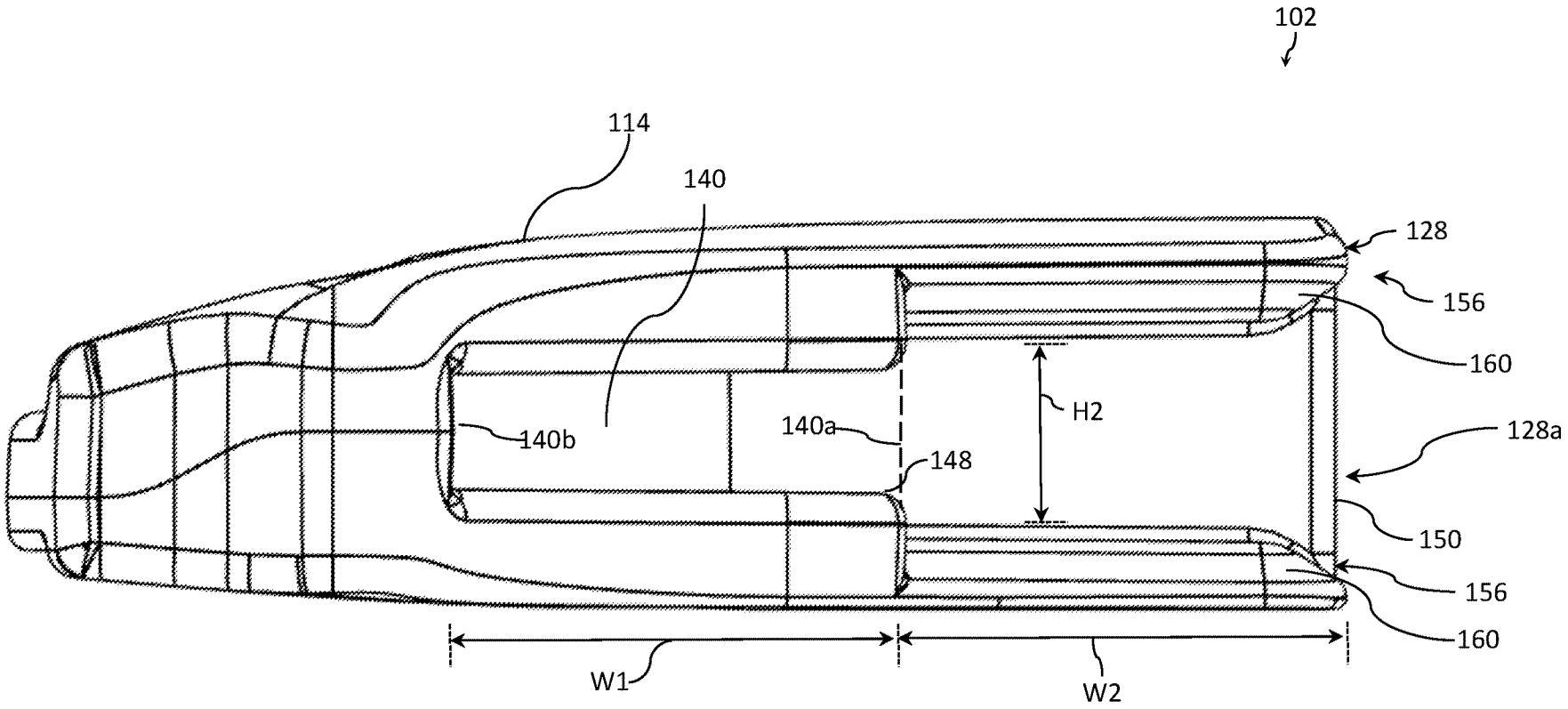
FIG. 2A illustrates a disconnected buckle assembly with a female buckle component in accordance with aspects of this disclosure.
Figure 2B:
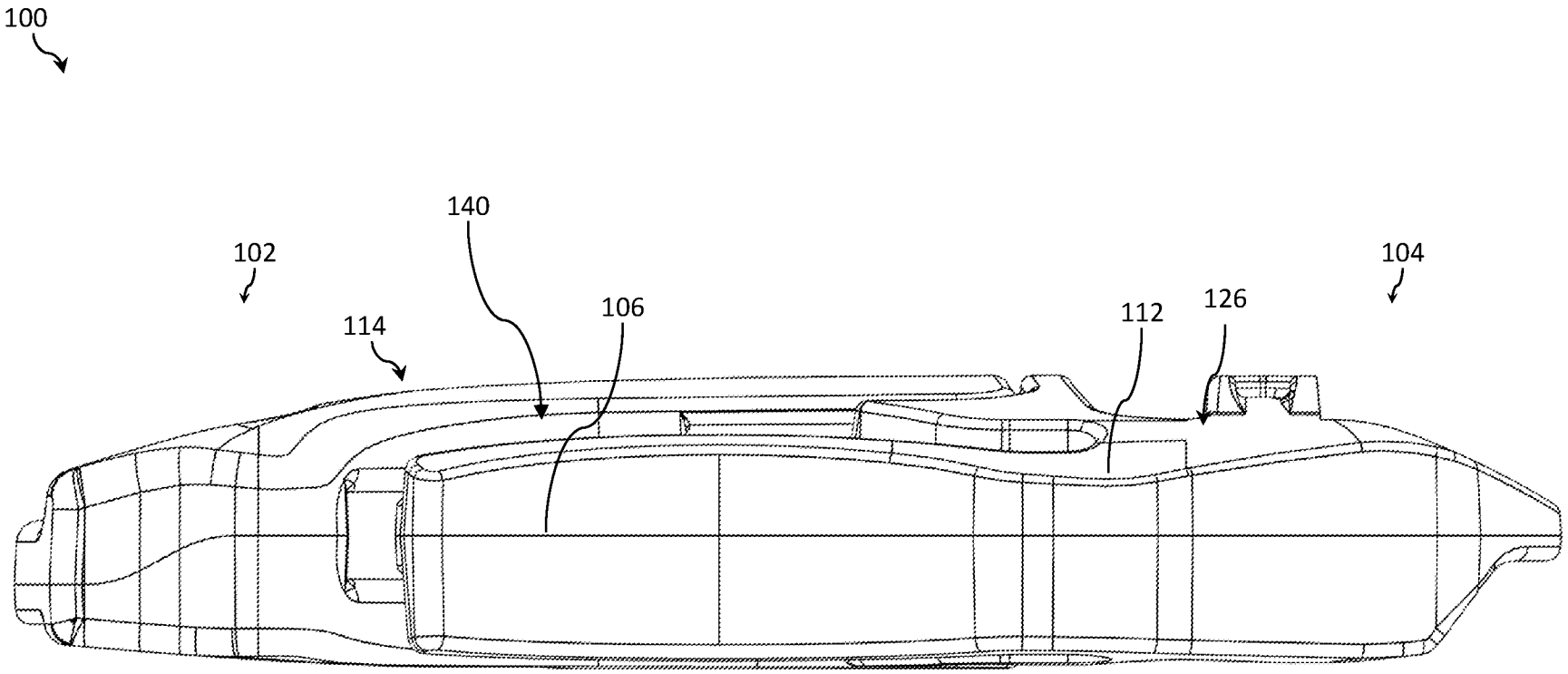
FIG. 2B illustrates a connected buckle assembly with the female buckle component of FIG. 2A and a male buckle component in accordance with aspects of this disclosure.

FIG. 2A illustrates a disconnected buckle assembly with a female buckle component 102 including a button aperture 140 and one or more alignment edges 156 in accordance with aspects of the disclosure. FIGS. 2A and 2B are described with respect to a single button aperture 140 and a pair of alignment edges 156. It should be noted that the following description of the button aperture 140 and alignment edges 156 applies to a buckle assembly 100 as a whole, including a button aperture 140 and one or more alignment edges on each side of the female buckle component 102 (e.g., the buckle assembly 100 having two button apertures 140 and four alignment edges 156). The button aperture 140 and the alignment edges 156 may be the same or substantially the same as described with respect to FIGS. 1A and 1B. The button aperture 140 may be any suitable shape such that button 106 of the male buckle component 104 can be snapably secured within button aperture 140. For example, the button aperture 140 may have a shape that substantially corresponds to the shape of the button 106 of the male buckle component 104.

As shown in FIG. 2A, the button aperture 140 may define a first width W1 (e.g., as measured in the direction of the length of the female buckle component 102 from a first proximal end 140*a* of the button aperture 140 to a first distal end 140*b* of the button aperture 140). In some examples, the first width W1 may be measured at the widest cross-section of button aperture 140 (e.g., as measured in the direction of the length of the female buckle component 102). The button aperture 140 may also define a first height H1 (e.g., as measured in a direction generally perpendicular to the first width W1). In some examples, the first height H1 may be measured at the longest cross-section of button aperture 140 (e.g., as measured in a direction generally perpendicular to the first width W1). A second width W2 may define the remainder of the width of the housing 114 (i.e., such that widths W1 and W2 together define the total width of housing 114). The second width W2 may be measured in the direction of the length of the female buckle component 102 from an entrance opening 128*a* to the pocket 128 to a first proximal end 140*a* of the button aperture 140. A second height H2 (e.g., as measured in a direction generally perpendicular to W1 and W2) may define the height of the portion of the housing defined by W2.

In some examples, the housing 114 of the female buckle component 102 includes one or more locking ledges 148 to interface with the male buckle component 104. For example, the housing 114 may define the locking ledge 148 at or near the proximal end 140*a* of the button aperture 140. In other examples, the locking ledge 148 may be located on a different part of the housing 114.

Secure mating of the male buckle component 104 into the female buckle component 102 requires the male buckle component 104 and the female buckle component 102 to be parallel to each other and in the same plane. However, in operation, the male buckle component 104 is often not aligned to be perfectly parallel and in the same plane as the female buckle component 102. Thus, female buckle component 102 may include one or more alignment edges 156 defined by the housing 114 that can be configured to align the male buckle component 104 to be parallel with female buckle component 102 during connection of buckle assembly 100. To that end, the alignment edges 156 may be configured to progressively align the male buckle component 104 to be parallel and in the same plane with female buckle component 102 as the male buckle component 104 is urged into the female buckle component 102 via insertion force 154 (e.g., in a situation where the male and female components are not parallel and in the same plane upon initiation of insertion force 154). As the male buckle 104 is inserted into female buckle component 102 at non-parallel angle with respect to a central plane that extends perpendicular to central rib 150, the alignment edges 156 can progressively adjust the angle of the of the male buckle component during assembly (i.e., as insertion force 154 urges the male and female components together) such that the male and female buckle components are parallel and in the same plane with one another.

In certain examples, each alignment edge 156 defines a chamfered edge 160. The chamfered edges 160 may extend from the proximal end 140*a* of the button aperture 140 to the entrance opening 128*a* to the pocket 128. In some examples, the chamfered edge 160 may extend from the proximal end 140*a* of a button aperture 140 and extend around a corner (or rounded corner) to a central rib 150 that bisects a first side of the female buckle component 102 from a second side of female buckle component 102. The female buckle component 102 may contain a pair of chamfered edges 160 spaced apart to define a height H2 (e.g., measured in the direction parallel to central rib 150). The chamfered edges 160 are sloped or angled edges that are configured to slope or angle away from a central plane that extends perpendicular to the central rib 150. The angle of one or more of the chamfered edges 160 may be less than 90°, less than 75°, less than or less than 25° relative to the central plane. In some examples, the angle of each chamfered edge 160 is 35° relative to the central plane. In some examples, each chamfered edge 160 may be the same angle relative to the central plane. In other examples, each chamfered edge 160 may comprise a different angle relative to the central plane.

In operation, chamfered edges 160 can provide an alignment effect as described above (i.e., facilitating the alignment of male buckle component 104 to be parallel with female buckle component 102 during connection of buckle assembly 100). To this end, as the male buckle component 104 is urged into the female buckle component 102 using insertion force 154, the locking tips 106*a* can interact with the chamfered edges 160 to provide an aligning effect.

FIG. 2B illustrates a connected buckle assembly with the female buckle component 102 of FIG. 2A and a male buckle component 104 in accordance with aspects of this disclosure. In some examples, such as the example illustrated in FIG. 2B.

Figure 3A:
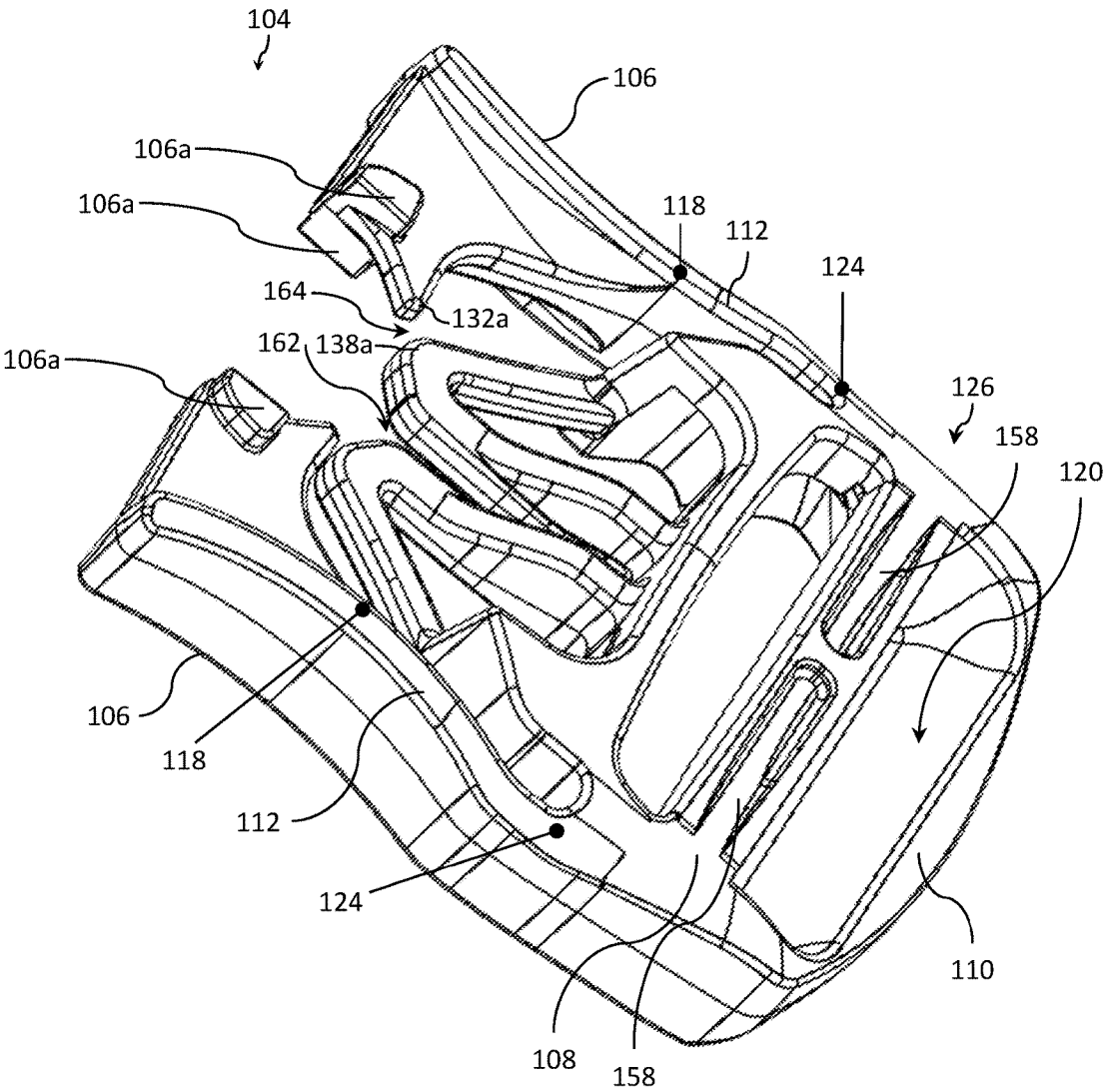
FIG. 3A illustrates another view of a disconnected buckle assembly with a male buckle component in accordance with aspects of this disclosure.
Figure 3B:
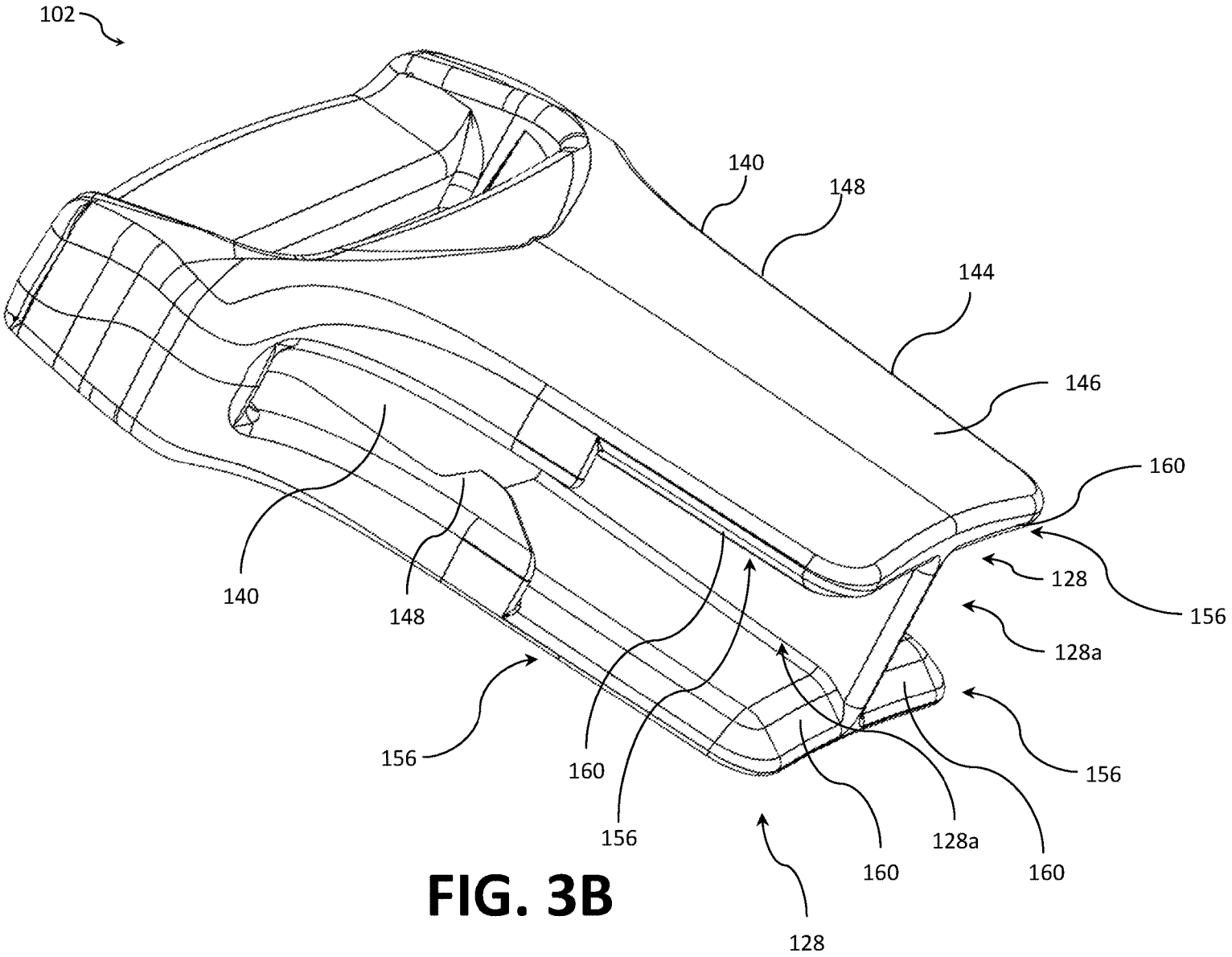
FIG. 3B illustrates a disconnected buckle assembly with a female buckle component in accordance with aspects of this disclosure.
Figure 3C:
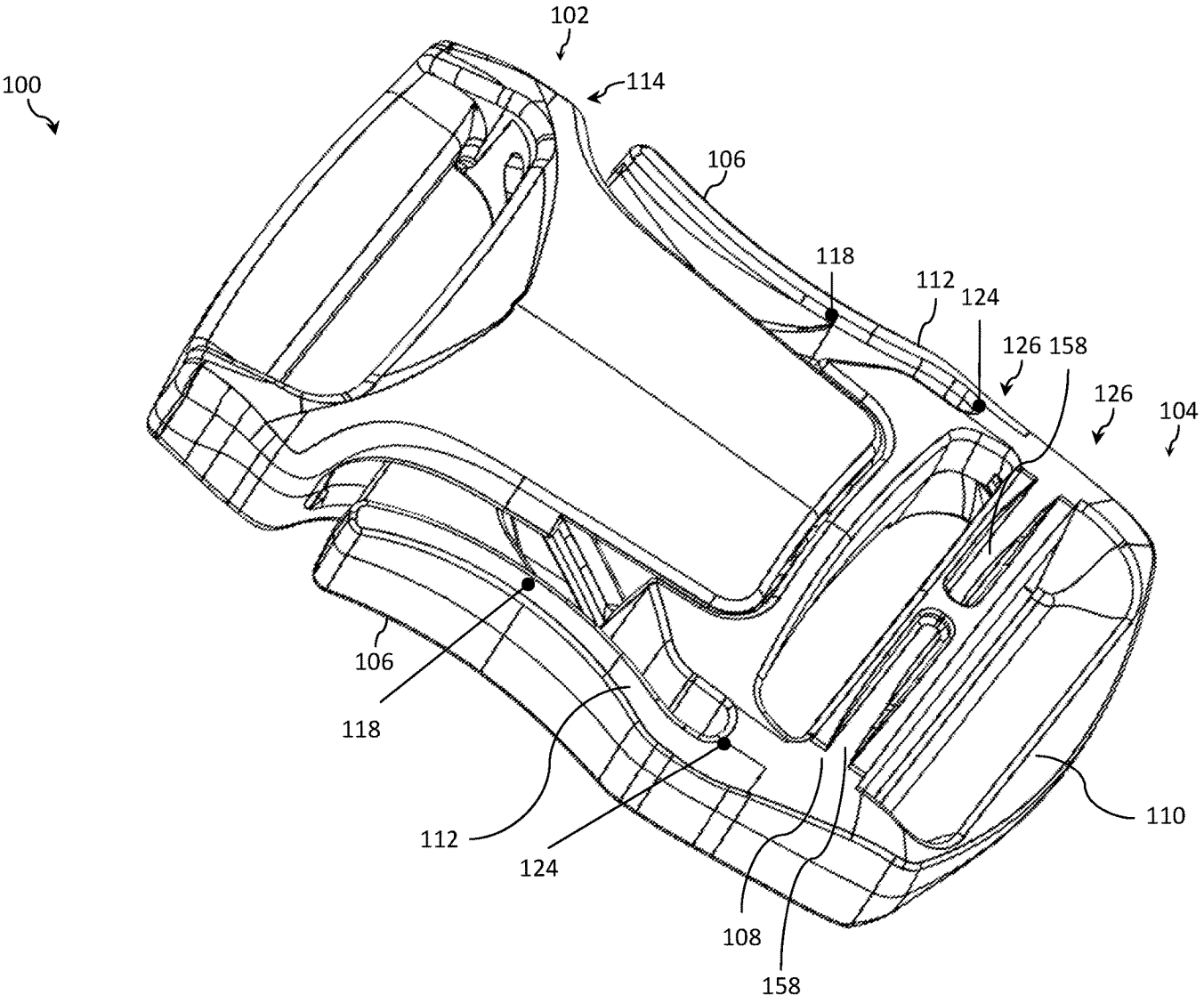
FIG. 3C illustrates a connected buckle assembly with the male buckle component of FIG. 3A and the female buckle component of FIG. 3B in accordance with aspects of this disclosure.

FIG. 3A illustrates another view of a disconnected buckle assembly 100 with a male buckle component 104 in accordance with aspects of this disclosure. FIG. 3B illustrates the disconnected buckle assembly 100 with a female buckle component 102 in accordance with aspects of this disclosure. FIG. 3C illustrates a connected buckle assembly 100 with the male buckle component 104 as illustrated in FIG. 3A and the female buckle component 102 as illustrated in FIG. 3B in accordance with aspects of this disclosure. FIGS. 3A-3C are substantially the same as the buckle assembly 100 described in connection with FIGS. 1A-2B.

While the present device and/or system has been described with reference to certain implementations, it will be understood by those skilled in the art that various changes may be made and equivalents may be substituted without departing from the scope of the present device and/or system. In addition, many modifications may be made to adapt a particular situation or material to the teachings of the present disclosure without departing from its scope. For example, components of disclosed examples may be combined, divided, re-arranged, and/or otherwise modified. Therefore, the present device and/or system are not limited to the particular implementations disclosed. Instead, the present device and/or system will include all implementations falling within the scope of the appended claims, both literally and under the doctrine of equivalents.

What is claimed is:

1. A female buckle component configured to mate with a male buckle component into a securely connected position, said female buckle component comprising:

a housing comprising a first side and a second side separated by a central rib, wherein each side of the housing defines:

a button aperture configured to secure a button of a male buckle component; and a pocket configured to receive the male buckle component, wherein the pocket comprises a first alignment edge at an opening of the pocket and a second alignment edge between the opening and the button aperture that is transverse to the first alignment edge.

2. The female buckle component of claim 1, wherein the first and second alignment edges are configured to align a male buckle component to be parallel with the female buckle component.

3. The female buckle component of claim 2, wherein each of the first and second alignment edges define a chamfered edge.

4. The female buckle component of claim 3, wherein the chamfered edge is configured to slope away from a central plane that extends perpendicular to the central rib.

5. The female buckle component of claim 4, wherein an angle of the chamfered edge is less than about 90° relative to the central plane.

6. The female buckle component of claim 4, wherein an angle of the chamfered edge is about 35° relative to the central plane.

7. The female buckle component of claim 2, wherein each side of the housing comprises one or more locking ledges configured to receive one or more locking tips of a male buckle component.

8. A buckle assembly comprising:

a female buckle component comprising a housing having a first side and a second side separated by a central rib, wherein the first side defines a first button aperture, a first pocket, and a first locking ledge, and wherein the second side defines a second button aperture, a second pocket, and a second locking ledge; and a male buckle component configured to mate with the female buckle component into a securely connected position, the male buckle component comprising:

a main body;

a first guide bar and a second guide bar coupled to the main body; and a first lateral arm and a second lateral arm coupled to the main body and configured to deflect about a pivot point, wherein the first lateral arm comprises a first flexible lateral arm, a first button configured to engage the first button aperture, a first locking tip configured to engage the first locking ledge, and a first guide fin, and wherein the second lateral arm comprises a second flexible lateral arm, a second button configured to engage the second button aperture, a second locking tip configured to engage the second locking ledge, and a second guide fin.

9. The buckle assembly of claim 8, wherein relative positions of the first and second guide fins and the first and second guide bars are configured to align the male buckle component with the female buckle component.

10. The buckle assembly of claim 9, wherein a distal tip of the first guide fin and a distal tip of the first guide bar are positioned to define a first gap and wherein a distal tip of the first guide fin and a distal tip of the second guide bar are positioned to define a second gap, wherein each gap is smaller than a width of the central rib of the female buckle component.

11. The buckle assembly of claim 8, wherein the first guide bar and the second guide bar are positioned to define a space that is configured to engage with the central rib of the female buckle component.

12. The buckle assembly of claim 11, wherein a width of the space defined by the first guide bar and the second guide bar is equal to or greater than a width of the central rib of the female buckle component.

13. The buckle assembly of claim 11, wherein a width of the space defined by the first guide bar and the second guide bar is greater than a width of the central rib of the female buckle component.

14. The buckle assembly of claim 10, wherein the first and second gaps enables progressive guidance of the central rib of the female buckle component into a space defined by the first guide bar and the second guide bar.

15. The buckle assembly of claim 8, wherein each lateral arm comprises two locking tips.

16. The buckle assembly of claim 8, wherein a distal tip of the first guide fin and a distal tip of the first guide bar are sized and positioned to define a first clearance and a distal tip of the second guide fin and a distal tip of the second guide bar are positioned to define a second clearance.

17. The buckle assembly of claim 16, wherein the first and second clearance enable the first and second locking tips to disengage from the first and second locking ledges of the female buckle component.

18. A male buckle component configured to mate with a female buckle component having a first side that defines a first button aperture, a first pocket, and a first locking ledge, and a second side that defines a second button aperture, a second pocket, and a second locking ledge, the male buckle component comprising:

a main body;

a first guide bar and a second guide bar coupled to the main body; and a first lateral arm and a second lateral arm coupled to the main body and configured to deflect about a pivot point, wherein the first lateral arm comprises a first flexible lateral arm, a first button configured to engage the first button aperture, a first locking tip configured to engage the first locking ledge, and a first guide fin, and wherein the second lateral arm comprises a second flexible lateral arm, a second button configured to engage the second button aperture, a second locking tip configured to engage the second locking ledge, and a second guide fin.

19. The male buckle component of claim 18, wherein relative positions of the first and second guide fins and the first and second guide bars are configured to align the male buckle component with the female buckle component.

20. The male buckle component of claim 19, wherein a distal tip of the first guide fin and a distal tip of the first guide bar are positioned to define a first gap and wherein a distal tip of the first guide fin and a distal tip of the second guide bar are positioned to define a second gap, wherein each gap is smaller than a width of a central rib of the female buckle component.

* * * * *